US005906093A

United States Patent [19]

Coslow et al.

[11] Patent Number: 5,906,093

[45] Date of Patent: May 25, 1999

[54] GAS TURBINE COMBUSTOR TRANSITION

[75] Inventors: Billy Joe Coslow, Winter Park, Fla.; Graydon Lane Whidden, Great Blue, Conn.

[73] Assignee: Siemens Westinghouse Power Corporation, Orlando, Fla.

[21] Appl. No.: 08/803,614

[22] Filed: Feb. 21, 1997

[51] Int. Cl.[6] ..... F02G 3/00

[52] U.S. Cl. ..... 60/39.02; 60/752; 60/39.37

[58] Field of Search ..... 60/39.02, 752, 60/39.83, 39.37, 730, 760, 39.511

[56] References Cited

U.S. PATENT DOCUMENTS

| | | | |
|---|---|---|---|
| 4,719,748 | 1/1988 | Davis, Jr. et al. | 60/39.37 |
| 5,027,604 | 7/1991 | Krueger | 60/752 |
| 5,226,278 | 7/1993 | Meylan et al. | 60/752 |
| 5,237,813 | 8/1993 | Harris et al. | 60/752 |
| 5,351,474 | 10/1994 | Slocum et al. | 60/39.37 |
| 5,685,158 | 11/1997 | Lenahan et al. | 60/39.02 |

FOREIGN PATENT DOCUMENTS

| | | | |
|---|---|---|---|
| 0309733 | 12/1988 | Japan | 60/760 |

*Primary Examiner*—Charles G. Freay

[57] ABSTRACT

A method of converting a steam cooled transition to an air cooled transition in a gas turbine having a compressor in fluid communication with a combustor, a turbine section in fluid communication with the combustor, the transition disposed in a combustor shell and having a cooling circuit connecting a steam outlet and a steam inlet and wherein hot gas flows from the combustor through the transition and to the turbine section, includes forming an air outlet in the transition in fluid communication with the cooling circuit and providing for an air inlet in the transition in fluid communication with the cooling circuit.

20 Claims, 6 Drawing Sheets

GAS TURBINE COMBUSTOR TRANSITION

The U.S. Government has a paid-up license in this invention and the right in limited circumstances to require the patent owner to license others on reasonable terms as provided for by the terms of contract No. DE-FC21-95MC32267 awarded by the Department of Energy.

BACKGROUND OF THE INVENTION

This invention relates to a method of converting a steam cooled gas turbine combustor transition to an air cooled combustor transition.

As will be appreciated by those skilled in the art, a typical gas turbine has a compressor, a combustor and a turbine section. In the compressor, air is compressed and then flows to the combustor. In the combustor, the air is burned with fuel to produce a hot gas. The hot gas flows from the combustor and into the turbine section. While flowing through the turbine section, the gas expands and causes a rotor shaft to rotate. Rotation of the shaft produces useful work. For example, the shaft may drive an electrical generator to produce electricity.

Also well known is the construction of a typical combustor. Traditionally, a gas turbine employs a plurality of combustors and a combustor transition connected to each combustor. The combustor transitions connect the combustors to the inlet of a single turbine. As mentioned above, hot gas is produced in the combustor. This hot gas then flows through the transitions and into the turbine. One of the functions of the transitions is to change the profile of the flowing gas from a cylindrical shape to an annular shape. As is well known, an annular shape is preferred because of the design of the turbine.

Since the thermodynamic efficiency of a gas turbine is dependent upon the temperature of the gas exiting the transition and entering the turbine, the gas temperature is relatively high. Since the transitions are in contact with this hot gas and are of metal construction, they must be cooled. Generally, transitions are cooled with either steam or air.

Because steam and air have significantly different heat capacities, in order to achieve the requisite heat transfer rate with either steam or air, different flow paths are provided in transitions for cooling with either steam or air. More particularly, transitions are designed specifically to employ either air or steam. Transitions employing air as a coolant are significantly different than those employing steam as a coolant. Unfortunately, having transitions that are significantly different based on the cooling medium has its disadvantages. For example, if one owns turbines having air cooled transitions and steam cooled transitions, he may have to maintain an inventory of both types of transitions for maintenance purposes. Consequently, inventory costs associated with stocking both types of transitions and maintaining parts for both transitions are high. If a transition could be readily adapted for use in either a steam or an air cooling system, this would reduce inventory costs. Additionally, if a method of adapting a transition to be cooled by either steam or air could be developed, this would also aid in reducing inventory costs.

A steam cooled transition that can be readily adapted to employ air as a coolant is also beneficial because it permits a turbine operator to have a "back up" method of cooling. Specifically, if the steam cooling system should fail, the turbine would not be operational. However, if a steam cooled transition could be adapted to employ air cooling, then the turbine could be placed in operation with air as the cooling medium. Thus, it is apparent that a steam cooled transition that can be readily adapted to employ air as the coolant may not only reduce inventory costs, but also may provide a more reliable operational system.

SUMMARY OF THE INVENTION

According to the invention there is provided a method of converting a steam cooled transition to an air cooled transition. This method may be practiced with a transition having an inlet for directing cooling steam to a cooling circuit and an outlet for exhausting the cooling steam from the cooling circuit. Additionally, the transition may be disposed in a combustor shell of a gas turbine having a compressor, a combustor and a turbine section. As mentioned above, in operation the compressor may produce pressurized air. One of the functions of this air is to flow to the combustor and burn with fuel to produce hot gas. From the combustor, the hot gas flows through the transition and into the turbine section. The method employed to convert such a transition may include the steps of providing an air inlet in the transition through which air can flow into the cooling circuit and forming an air outlet in the transition through which air that has traveled through the cooling circuit is exhausted.

This invention also includes a transition that is convertable from a steam cooled transition to an air cooled transition. In further detail, such a transition includes a removable steam supply manifold and a removable steam collection manifold mounted on a periphery of the transition. Enclosed by these manifolds are a plurality of apertures arranged on the periphery of the transition. These apertures may define a path through which steam enters and exits the cooling circuit. When these steam manifolds are removed, the plurality of apertures serve as an outlet for air to exhaust from the cooling circuit. Furthermore, an air supply manifold is disposed on the periphery of the transition and encloses a plurality of openings through which air is supplied to the cooling circuit. This transition may be disposed in a combustor shell of a gas turbine as described above.

This invention also includes a gas turbine as described above that employs a pump disposed between the shell and the transition described above. In such a turbine, the pump is in fluid communication with the shell and the transition. In addition, the pump functions to provide a driving force for coolant to flow from the shell to the transition and back to the shell. While flowing through the transition, the coolant absorbs heat from the transition.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENTS

Figure 1:
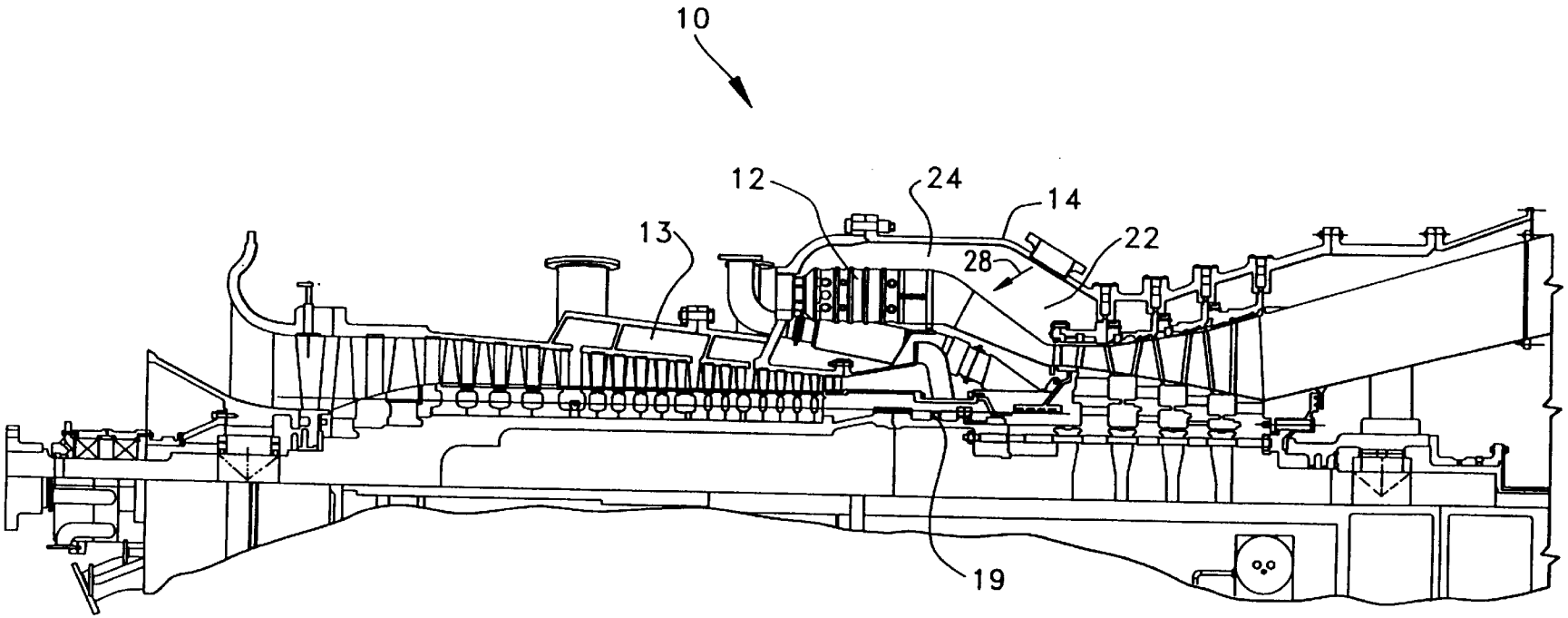
FIG. 1 (PRIOR ART)
FIG. 1 is a cross section of a prior art combustion turbine.

Referring now to the drawings, wherein like reference numerals designate corresponding structure throughout the views, and referring in particular to FIG. 1, a gas turbine 10 includes a combustor 12, a compressor 13 and a turbine section 16. As will be appreciated by those skilled in the art, a gas turbine 10 typically has a plurality of combustors 12 contained within a turbine casing 14 and in flow communication with the turbine section 16. Since all of these combustors 12 are of similar construction, one such combustor is depicted in FIG. 1.

As pictured in FIG. 1, the combustor 12 is in flow communication with the compressor 13. In the compressor 13 air is compressed and then sent into the shell 24 contained within the turbine casing 14. From the shell 24, air flows into the combustor 12 through orifices in the surface of the combustor 12. While in the combustor 12, the air mixes with the fuel and a hot gas is produced. The hot gas then flows from the combustor 12 through the transition 22 and into the turbine section 16. In the turbine section 16, the hot gas drives a rotor 19. Attached to the rotor 19 is a load (not shown as it would be obvious to one skilled in the art) such as an electrical generator that converts the rotation of the rotor 19 into useful work.

As is well known the gas passing through the transition 22 is extremely hot. Consequently, cooling the transition 22 is vital. Conventionally, the transition 22 was cooled by compressed air, indicated by arrow 28, flowing in the shell 24. Specifically, this air 28 would flow over the outer surface of the transition 22 and provide cooling. However, with the never ending search to increase the efficiency of gas turbines, the gas flowing through the transition 22 continues to be elevated in temperature, resulting in the transition 22 needing improved cooling systems.

As a result, advanced air cooling systems have been developed. Additionally, steam cooling systems have been developed. Since steam has a significantly higher heat capacity than air, it can provide greater cooling capabilities. Moreover, since steam and air have different heat capacities, they must travel at different velocities or traverse different flow paths in order to achieve the requisite cooling. Typically, this is accomplished by designing the flow path of the coolant through the transition 22 to accommodate the characteristics of the cooling medium employed. Since these flow paths are significantly different, transitions that are designed to use air generally cannot substitute steam as a coolant, and transitions that are designed to employ steam generally cannot replace the steam with air. This invention provides for a method of adapting a steam cooled transition 22, as depicted in FIG. 4, to an air cooled transition.

Figure 2:
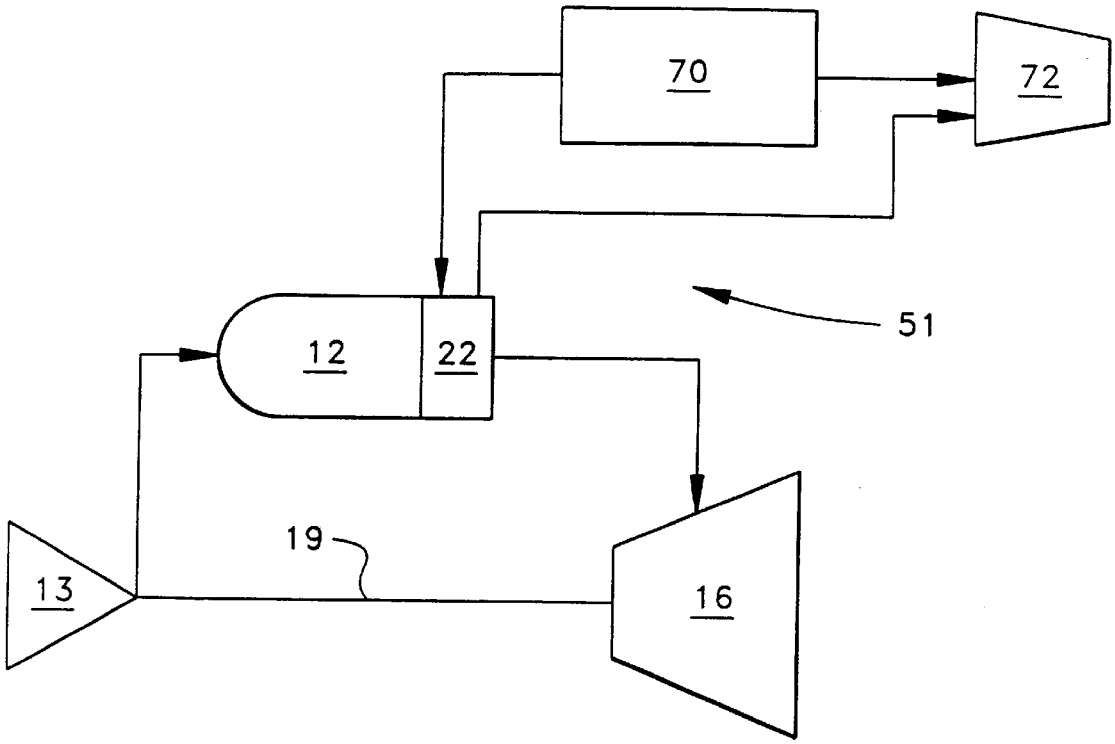
FIG. 2 (PRIOR ART)
FIG. 2 is a schematic diagram of a prior art steam cooling system for a turbine transition.

FIG. 2, depicts a schematic diagram of a typical steam cooling system 51 for a transition 22. As depicted, the steam is produced in a heat recovery steam generator 70, or another steam producing device, and is sent to the transition 22. While traveling through the transition 22, the steam cools the transition 22 and then flows to a steam return 72, such as a steam turbine, where the energy in the steam is converted into work.

Figure 3:
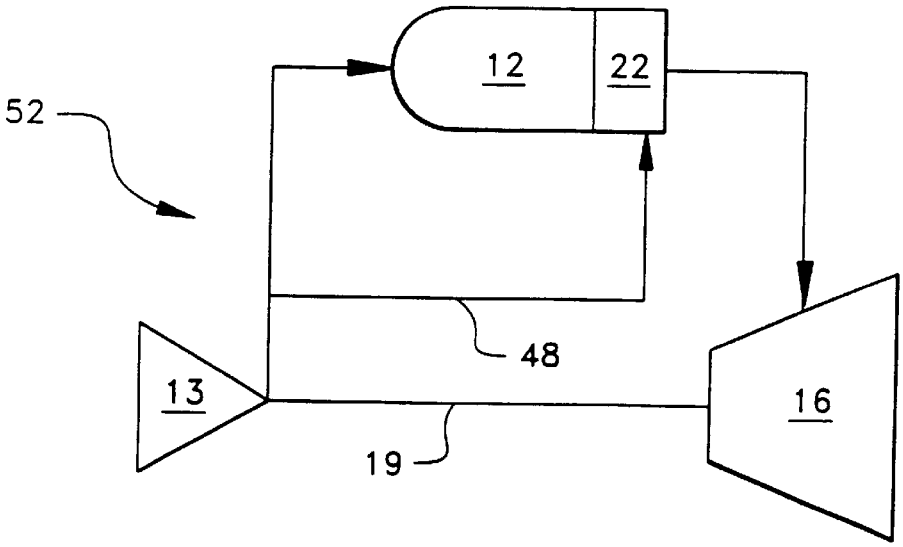
FIG. 3 (PRIOR ART)
FIG. 3 is a schematic diagram of a prior art air cooling system for a turbine transition.

In contrast to the steam cooling system 51, FIG. 3 depicts a schematic of an air cooling system 52. In a typical air cooling system 52, air is directed from the compressor 13 to the transition 22. While flowing through the transition 22, the air cools the transition 22. After flowing through the transition 22, the air exhausts into the combustor 12 or an interior of the transition 22. Here, the heated air mixes with air sent from the compressor 13 to the combustor 12. As those skilled in the art will appreciate, this type of system is regarded as relatively thermodynamically efficient because the energy in the air (the air that cooled the transition) is converted into useful work in the turbine 16. Specifically, after entering the combustor 12 the air mixes with fuel to produce a hot gas that drives the rotor 19 in the turbine section 16. Although the schematic depicts the cooling being supplied from the compressor 13 disposed in the turbine 10, the cooling air may be supplied from a compressor, or similar source, external to the turbine 10.

Figure 4:
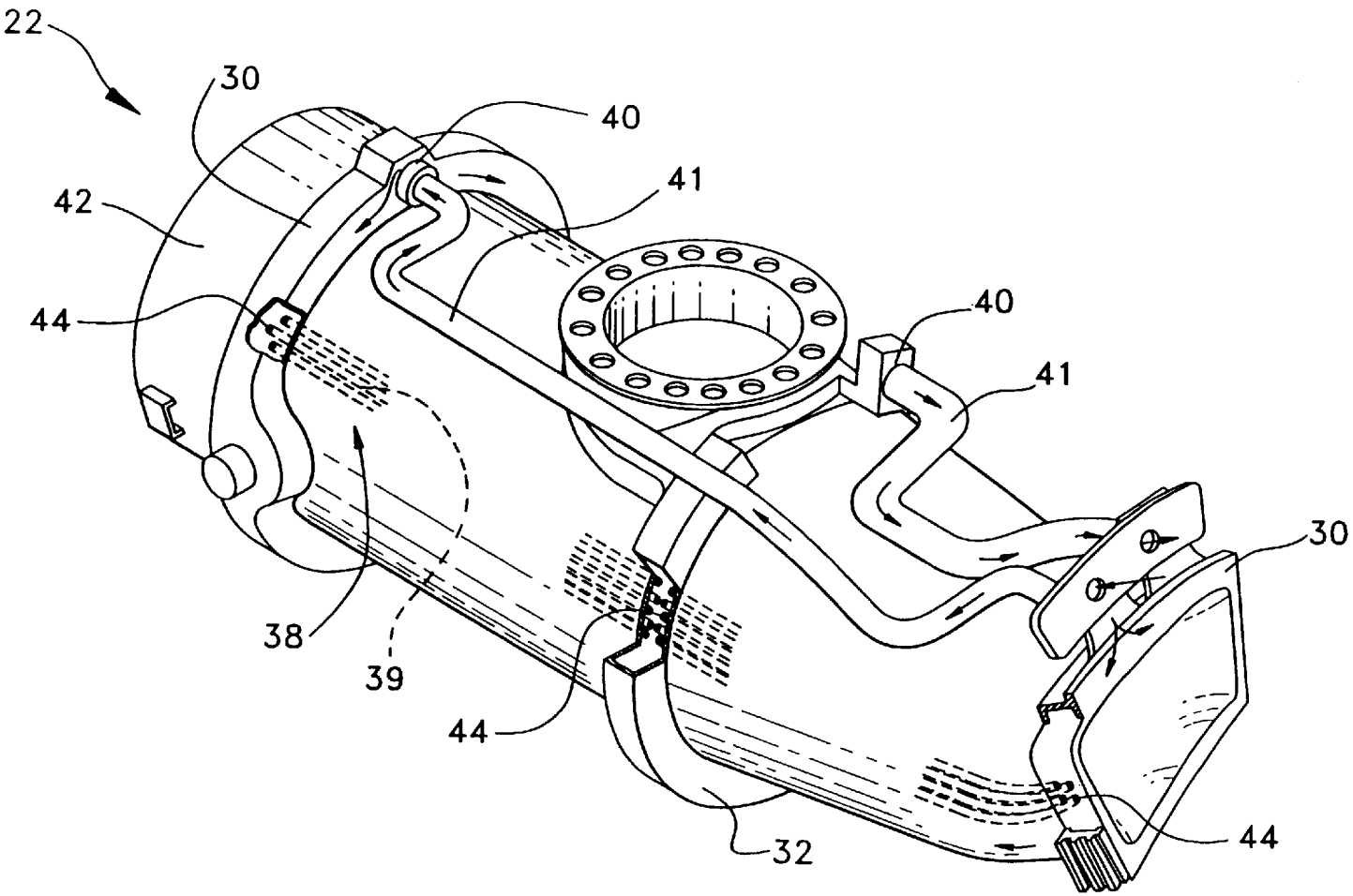
FIG. 4 (PRIOR ART)
FIG. 4 is a prior art isometric view of a combustor transition.

As illustrated in FIG. 4, a steam cooled transition 22 includes a main body 42, a steam supply manifold 30, a steam collection manifold 32 and an internal cooling circuit 38. This invention does not relate to the particular design of the steam cooled transition 22, but to a method of converting this transition to an air cooled transition. The transition 22 depicted in FIG. 4 has two steam supply manifolds 30. As depicted, the steam supply manifolds 30 and the steam collection manifold 32 run circumferentially around the periphery of the main body 42. In addition, the steam supply manifolds 30 are disposed at opposing longitudinal ends of the main body 42. In contrast, the steam collection manifold 32 is disposed between the steam supply manifolds 30. Both the supply manifolds 30 and the collection manifold 32 enclose a plurality of apertures 44 running circumferentially around the main body 42.

As is also depicted in FIG. 4, the steam collection manifold 32 and the steam supply manifolds 30 have ports 40 arranged on an exterior of the manifolds 30,32. The ports 40 on the steam supply manifolds 30 are connected to a steam supply 70, such as a heat recovery steam generator as depicted schematically in FIG. 2, by a conduit 41 or similar apparatus, such as a pipe. Additionally, the steam collection manifold 32 is connected to a steam return 72, such as a steam turbine, by a conduit 41, or similar connecting apparatus, attached to its port 40.

Typically, the manifolds 30,32 are welded to the transition 22. Similarly, the conduits 41 are also welded to their respective ports 40. However, as those skilled in the art will appreciate, the conduits 41 may be connected to the ports 40 by a similar fastening technique, including but not limited to, threaded fasteners, rivets and the like. Similarly, the manifolds 30, 32 may be affixed to the transitions 22 by other well known fastening techniques including, but not limited to, threaded fasteners or rivets and the like.

Figure 6:
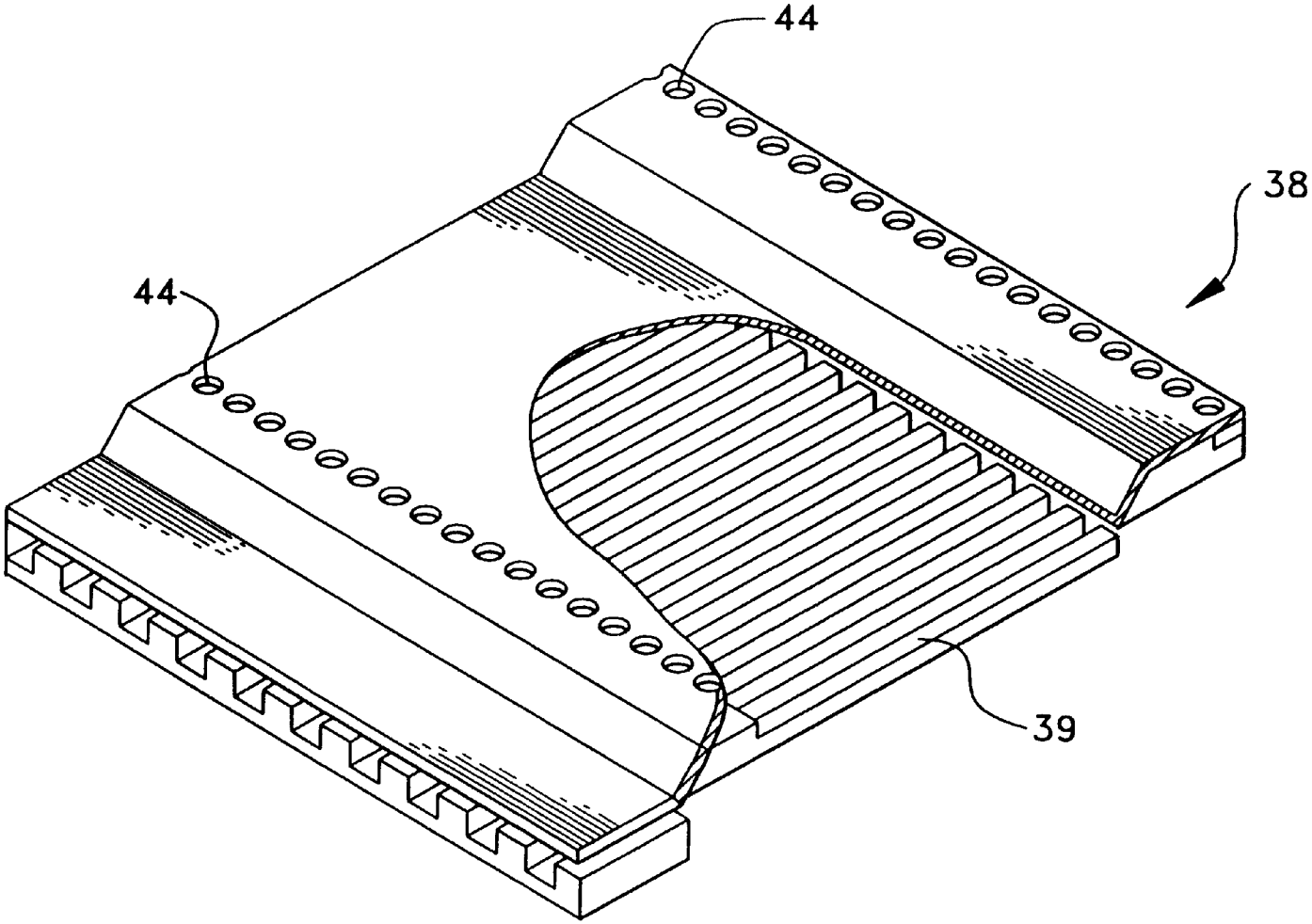
FIG. 6 is an isometric view of a component that may be employed in the practice of the transitions.

The cooling circuit 38 is illustrated in FIGS. 4 and 6. As indicated the cooling circuit 38 includes a plurality of channels 39 on the interior of the transition 22 running along the longitudinal axis 23 of the transition 22. In this embodiment, the plurality of channels 39 may be referred to as a fin ring because they create a ring of channels 39 running around the circumference of the interior of the transition 22. Additionally, the cooling circuit 38 employs the apertures 44 in the transition 22 underneath the manifolds 30, 32. More specifically, a coolant flow path is formed from the apertures 44 enclosed by the supply manifolds 30 through the cooling channels 39 and to the apertures 44 enclosed by the collection manifold 32. It will be appreciated that FIG. 6 illustrates only a portion of the cooling circuit 38. It depicts some of the channels 39 that run between the apertures 44 enclosed by one of the steam supply manifolds 30 and the apertures 44 enclosed by the steam collection manifold 32. The channels 38 running between the apertures 44 in the other steam supply manifold 30 and the steam collection manifold 32 are similar. Additionally, it will be appreciated that these channels 39 line the entire circumference of the interior of the transition 22, but only a portion of these channels is shown in FIG. 6.

In operation, as is best illustrated in FIG. 4, steam cools the transition 22 by flowing from the steam supply 70, depicted schematically in FIG. 2, to the steam supply manifolds 30 and into the cooling circuit 38. In the cooling circuit 38, the steam provides most of the cooling for the transition 22. After flowing through the cooling circuit 38, the steam flows to the collection manifold 32. From the collection manifold 32, the steam then flows to a steam return 72 as described above, such as a steam turbine.

The gas turbine 10, the steam cooling system 51, the air cooling system 52 and the steam cooled transition 22 discussed above are prior art. This invention does not relate to them per se, but rather to a method of converting a steam cooled transition to an air cooled transition, employing such a transition in a gas turbine and a cooling system for such a transition.

In order to convert this steam cooled transition 22 to an air cooled transition, a preferred embodiment of this invention includes the steps of forming an air outlet 36 in the transition 22 and in flow communication with the cooling circuit 38; and providing for an air inlet 46 in the main body 42 of the transition 22 in flow communication with the cooling circuit 38.

More specifically, the step of forming an air inlet 46 may include the steps of forming a plurality of openings 50 in the main body 42 that extend through the main body 42 and into the cooling circuit 38. In the preferred embodiment, these apertures are formed circumferentially around the main body 42 at two different points on the longitudinal axis of the transition 22. Similar to the apertures 44, depicted in FIG. 6, these openings 50 extend through the transition 22 and provide a path to the cooling circuit 38. As those skilled in the art will appreciate, these openings 50 may be formed by drilling, boring or another similar manufacturing technique. Additionally, as those skilled in the art will appreciate, the method may further include the steps of cleaning and polishing the openings and flushing the system.

Figure 5:
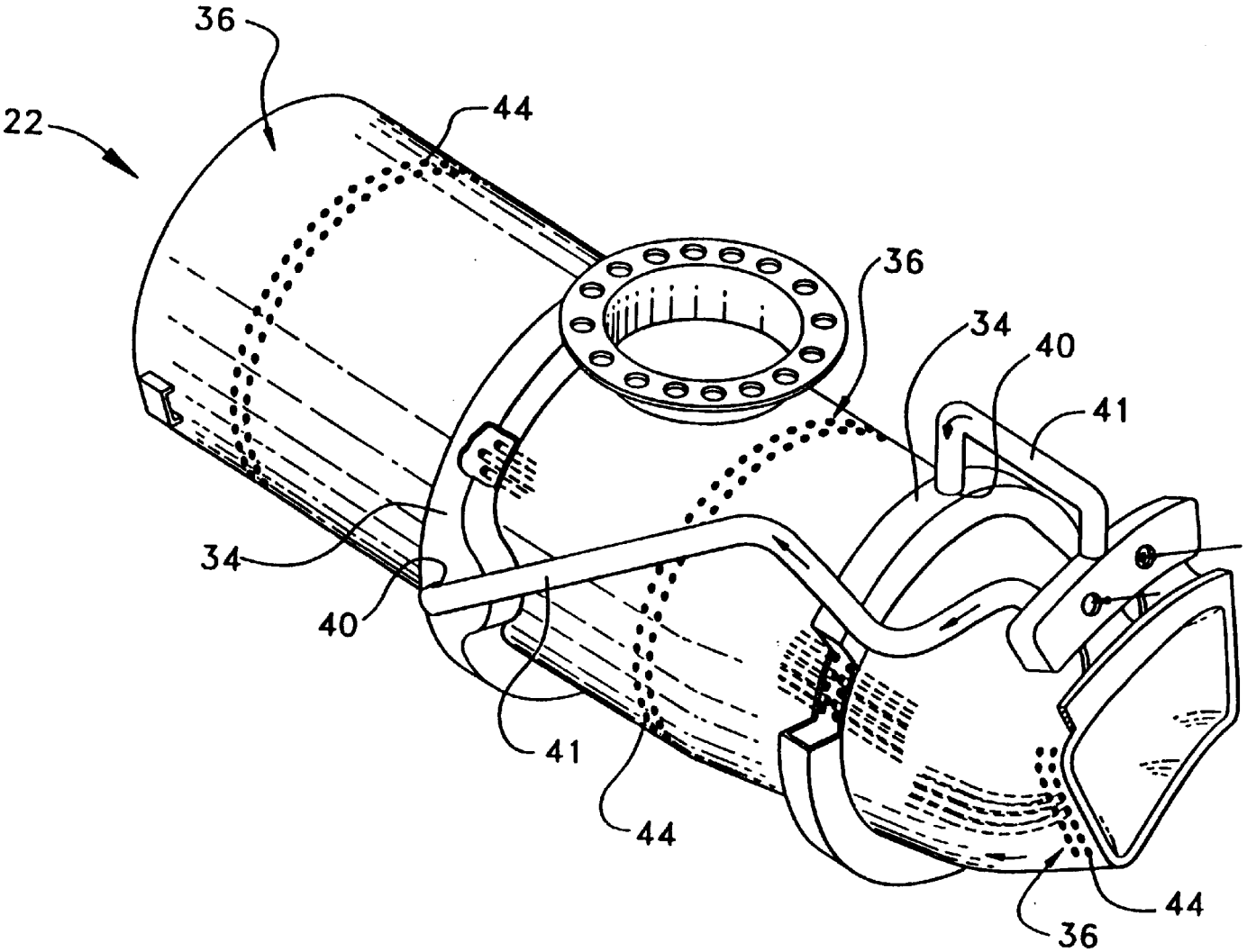
FIG. 5 is an isometric view of a combustor transition according to a preferred embodiment of this invention.

The preferred method may further include attaching an air supply manifold 34 to the main body 42. As illustrated in FIG. 5, in the most preferred embodiment of this invention this step entails attaching two air supply manifolds 34. The air supply manifolds 34 are installed circumferentially around the periphery of the transition 22 and cover the openings 50. Similar to the steam manifolds 30,32, the air supply manifolds 34 have a port 40 located on their exterior.

This step of installing the air supply manifolds 34 may include welding the manifolds 34 to the transition 22. Alternatively, the manifolds 34 may be affixed to the transition 22 by employing other well known fastening techniques, including but not limited to adhesives, threaded fasteners and rivets.

An additional step of connecting an air supply to the air supply manifolds 34 at its ports 40 may be included within this invention. As mentioned above and as depicted in schematically in FIG. 3, the air supply may be an external air compressor or air supplied from the outlet of the compressor 13. Specifically, this step may include connecting a conduit 41 to the air supply manifold 34 at its port 40 and running the conduit 41 to an air supply. In the preferred embodiment, this step includes welding the conduit 41 to the port 40 on the air manifold 34. However, the conduit 41 may be connected by other well known means, including but not limited to, threaded connectors, adhesives, clamps and the like.

Preferably, this method also encompasses the steps of disconnecting the steam supply 70 from the steam supply manifold 30 and disconnecting the steam return 72 from the steam collection manifold 32. As mentioned above, the manifolds 30,32 are connected to the respective supply and return by conduits 41 welded to the respective ports 40. Therefore, the step of disconnecting the steam supply 70 may include the step of cutting the weld between the conduits 41 and the ports 40. As discussed above, the conduits 41 may be connected to the ports 40 by another similar fastening technique or with threaded fasteners and the like. As those skilled in the art will appreciate, in these embodiments, the steps of removal would correspond to the particular fastening method employed.

The step of forming an air outlet may include removing the steam supply manifolds 30 and the steam collection manifolds 32 and exposing the apertures 44 in the main body 42. In the most preferred embodiment, the steam manifolds 30,32 are connected to the transition 22 by welds. Consequently, the step of removing these manifolds 30,32 encompasses the steps of cutting the welds, cleaning, finishing and polishing the transition surface where the weld was cut. As those skilled in the art will appreciate, the manifolds may be connected by a similar fastening technique or another fastening technique such as threaded connections, or the like. As will also be appreciated by those skilled in the art, the steps of removal in these embodiments would correspond to the particular fastening technique used. For example, removing threaded fasteners and cleaning the threaded holes.

After the manifolds 30, 32 are removed, the apertures 44 enclosed by the manifolds 30, 32 may be exposed and placed in flow communication with the shell 24. Through these steps, as is detailed further below, a flow path is created that allows air to exhaust into the shell 24 and mix with air exiting the compressor 13.

After these steps are completed, the transition 22 may now be air cooled. Specifically, air can flow from the air supply through conduits 41 and the port 40 on the air supply manifold 34. The air supply manifold 34 then directs the air through the openings 50 and into the cooling circuit 38. The air then traverses the flow path provided for by the cooling circuit 38 and heat is transferred to the air from the hot transition 22. Some of the air flows in the cooling circuit 38 toward the center of the transition 22 and to the outlet 36 arranged near the center. Additionally, some of the air entering the inlets 46 flows toward the longitudinal ends of the transition 22 and toward the outlets 36 arranged at these ends. After flowing through the circuit 38, the air then flows through the apertures 44 and into the combustor shell 24 where it mixes with air exiting the compressor 13.

Since this air cooled transition exhausts cooling air into the combustor shell 24 and the air cooling system described in FIG. 3 supplies air directly from the shell 24, the transition formed in this invention cannot be employed with this system. More specifically, if the transition formed in this invention was employed in such a system, there would be minimal air flow because the supply air and the return air would be at about the same pressure. Thus, a new air cooling system is needed in order to utilize the transition formed in this invention.

Figure 7:
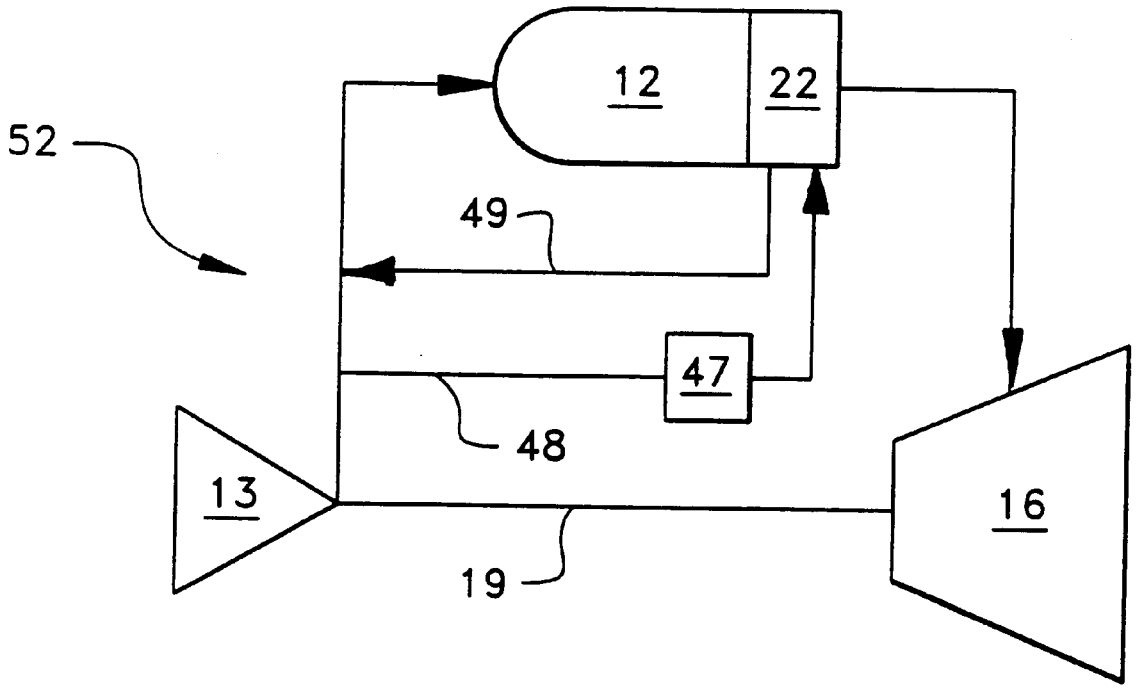
FIG. 7 is a schematic diagram of an air cooling system for a transition according to a preferred embodiment of this invention.
Figure 5:
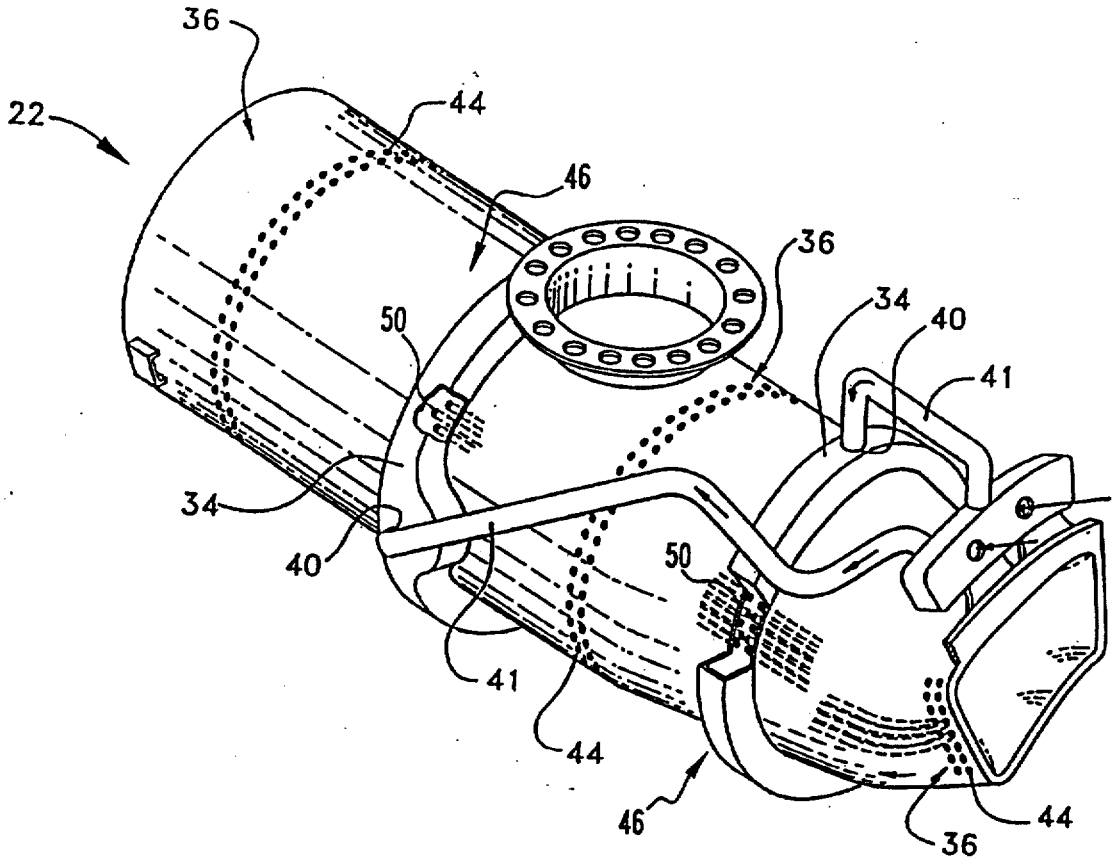

Such a system is illustrated schematically in FIG. 7. This system employs a pump 47 or a similar device to further pressurize the cooling air. Specifically, air from the outlet 48 of the compressor 13 flows to the pump 47 where it is further pressurized. The pump 47 then directs the air through the conduits 41 and into the air supply manifolds 34. After flowing through the cooling circuit 38 the air 49 then exhausts into the shell 24. In this system, the pump 47 or similar device provides the driving force needed to create flow through the cooling circuit.

As discussed above air and steam have significantly different heat capacities. Thus, to provide about the same cooling with air and steam they must either traverse a different cooling path in the transition and/or flow through the transition at a different velocity. In order to achieve about the same degree of cooling with each cooling medium, this invention may also include a step of selecting a location along the transition 22 for the air inlets 46. As indicated in FIG. 5, in the preferred embodiment of this invention, each air inlet is situated along the transition 22 between the location of air outlets 36. Selecting the location of the air inlets 46 determines how far through the cooling circuit 38 the air will flow until it reaches the air outlets 36. As is evident from a comparison of FIGS. 4 and 5, the length of travel of air through the cooling circuit 38 is significantly shorter than the length of travel of steam through the cooling circuit 38. This shorter length of travel for the air compensates for its lower heat capacity and provides about the same amount of cooling as the steam provides.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

We claim:

1. A method of converting a steam cooled transition to an air cooled transition in a gas turbine comprising a compressor in fluid communication with a combustor, and a turbine section in fluid communication with the combustor, the transition disposed in a shell between the combustor and the gas turbine for communicating hot gases from the combustor through the transition to the turbine section, and the transition comprising a cooling circuit connecting a steam outlet and a steam inlet spaced apart along and in fluid communication with the cooling circuit, comprising the steps of:

forming an air inlet in the transition in fluid communication with the cooling circuit, at a location on the transition between the steam outlet and the steam inlet; and opening the steam outlet and steam inlet in the transition, to the shell so that the shell is in fluid communication with the cooling circuit forming an air outlet at the steam outlet and the steam inlet locations.

2. The method of claim 1, wherein the steam inlet comprises a steam supply manifold disposed on a peripheral portion of the transition in fluid communication with the cooling circuit and the method further comprises the step of removing the steam supply manifold.

3. The method of claim 1, wherein the steam outlet comprises a steam collection manifold disposed on a peripheral portion of the transition in fluid communication with the cooling circuit and the method further comprises the step of removing the steam collection manifold.

4. The method of claim 1, wherein the step of providing an air inlet comprises creating a plurality of openings disposed circumferentially around a peripheral portion of the transition.

5. The method of claim 4, further comprising the step of placing an air supply manifold around the peripheral portion of the transition and in flow communication with the openings.

6. The method of claim 5, further comprising the step of placing a conduit in fluid communication with a port disposed on a peripheral portion of the air supply manifold.

7. The method of claim 1, wherein the step of forming an air outlet further comprises opening or removing a steam supply manifold and a steam collection manifold from the transition, and exposing apertures in fluid communication with the cooling circuit and the shell.

8. The method of claim 1, further comprising the steps of forming an additional air outlet and providing an additional air inlet, the air inlet being arranged between two of the air outlets along a longitudinal axis of the transition with one air inlet separated from the other air inlet along the longitudinal axis with an air outlet therebetween.

9. The method of claim 1, wherein the steam inlet further comprises a steam supply manifold arranged on a peripheral portion of the transition in fluid communication with the cooling circuit and a conduit running from a port disposed on an exterior of the steam supply manifold to a steam supply and the method further comprises the step of disconnecting the port from the conduit.

10. A gas turbine comprising:

a compressor;

a combustor in fluid communication with the compressor;

a turbine section in fluid communication with the combustor; and an air cooled elongated transition, converted from a steam cooled transition, disposed in a shell and in fluid communication with the combustor and the turbine section comprising;

a cooling circuit extending circumferentially around interior walls of the transition and having a plurality of flow channels which extend along the longitudinal direction of the transition;

air outlets formed from (i) a plurality of steam inlets, generally positioned proximate the ends of the transition that interface with the combustor and the turbine, and (ii) a former steam outlet generally, centrally disposed between the steam inlets, said steam inlets and outlet formerly part of the steam cooled transition;

a plurality of air inlets positioned generally, centrally between the air outlets and disposed through the transition wall, communicating with the flow channels of the cooling circuit, the air inlets, flow channels and air outlets defining an air flow path that is substantially shorter than a steam flow path that the transition was originally designed for; and means for directing cooling air into the air inlets.

11. The turbine of claim 10, wherein the air outlets exhaust the cooling air into the shell.

12. The turbine of claim 10, wherein the air inlets extend circumferentially around the periphery of the transition at each of the air inlet longitudinal locations along the transition and are enclosed within a respective manifold at each of the longitudinal locations, that is connected to the means for directing cooling air into the air inlets.

13. A method of converting a steam cooled transition to an air cooled transition in a gas turbine comprising a compressor in fluid communication with a combustor, and a turbine section in fluid communication with the combustor, the transition disposed in a combustor shell between the combustor and the turbine, and comprising a cooling circuit connecting a steam outlet and a steam inlet, wherein hot gas flows from the combustor through the transition to the turbine section, comprising the steps of:

forming an air outlet in the transition to the shell, in fluid communication with the cooling circuit; and providing an air inlet in the transition in fluid communication with the cooling circuit, wherein the cooling path between the air inlet and the air outlet is substantially shorter in distance than the cooling path between the original steam inlet and steam outlet.

14. An Air cooled elongated transition, converted from a steam cooled transition, comprising;

a cooling circuit extending circumferentially around interior walls of the transition and having a plurality of flow channels which extend along the longitudinal direction of the transition;

air outlets formed from (i) a plurality of steam inlets, generally positioned proximate the ends of the transition that interface with the combustor and the turbine, and (ii) a former steam outlet generally, centrally disposed between the steam inlets, said steam inlets and outlet formerly part of the steam cooled transition;

a plurality of air inlets positioned generally, centrally between the air outlets and disposed through the transition wall, communicating with the flow channels of the cooling circuit, the air inlets, flow channels and air outlets defining an air flow path that is substantially shorter than a steam flow path that the transition was originally designed for; and means for directing cooling air into the air inlets.

15. The transition of claim 14, wherein the air outlets exhaust the cooling air into a combustion turbine shell surrounding the transition.

16. The transition of claim 14, wherein the air inlets extend circumferentially around the periphery of the transition at each of the air inlet longitudinal locations along the transition and are enclosed within a respective manifold at each of the longitudinal locations, that is connected to the means for directing cooling air into the air inlets.

17. A gas turbine comprising:

a compressor;

a combustor shell in fluid communication with the compressor;

a combustor in fluid communication with the shell;

a turbine section in fluid communication with the combustor;

an air cooled transition in fluid communication with the combustor and the turbine section;

a cooling circuit disposed in an interior section of the transition; and a pump disposed between the shell and the cooling circuit to provide a force for coolant to flow from the shell to the pump through the cooling circuit and to the shell.

18. The gas turbine of claim 17, wherein the transition further comprises an air supply manifold disposed on a peripheral portion of the transition and enclosing a plurality of openings in fluid communication with the cooling circuit and the pump.

19. The gas turbine of claim 17, wherein the transition further comprises a plurality of air outlets disposed on a peripheral portion of the transition in fluid communication with the cooling circuit and the combustor shell.

20. The gas turbine of claim 17, wherein the cooling circuit comprises cooling channels disposed between a plurality of air inlets disposed on a first peripheral portion of the transition and a plurality of air outlets disposed on a second peripheral portion of the transition.

* * * * *

UNITED STATES PATENT AND TRADEMARK OFFICE

CERTIFICATE OF CORRECTION

PATENT NO. : 5,906,093

DATED : May 25, 1999

INVENTOR(S) : Billy Joe Coslow, et al.

It is certified that error appears in the above-identified patent and that said Letters Patent is hereby corrected as shown below:

The title page, should be deleted to appear as per attached title page.

In the drawings, substitute drawing sheet 4 of 6 with attached sheet.

Signed and Sealed this

Second Day of January, 2001

*Attest:*

*Attesting Officer*

Q. TODD DICKINSON

*Commissioner of Patents and Trademarks*

US005906093A

United States Patent [19]

Coslow et al.

[11] Patent Number: 5,906,093

[45] Date of Patent: May 25, 1999

[54] GAS TURBINE COMBUSTOR TRANSITION

[75] Inventors: Billy Joe Coslow, Winter Park, Fla.; Graydon Lane Whidden, Great Blue, Conn.

[73] Assignee: Siemens Westinghouse Power Corporation, Orlando, Fla.

[21] Appl. No.: 08/803,614

[22] Filed: Feb. 21, 1997

[51] Int. Cl.[6] ..... F02G 3/00

[52] U.S. Cl. ..... 60/39.02; 60/752; 60/39.37

[58] Field of Search ..... 60/39.02, 752, 60/39.83, 39.37, 730, 760, 39.511

[56] References Cited

U.S. PATENT DOCUMENTS

| | | | |
|---|---|---|---|
| 4,719,748 | 1/1988 | Davis, Jr. et al. | 60/39.37 |
| 5,027,604 | 7/1991 | Krueger | 60/752 |
| 5,226,278 | 7/1993 | Meylan et al. | 60/752 |
| 5,237,813 | 8/1993 | Harris et al. | 60/752 |
| 5,351,474 | 10/1994 | Slocum et al. | 60/39.37 |
| 5,685,158 | 11/1997 | Lenahan et al. | 60/39.02 |

FOREIGN PATENT DOCUMENTS

| | | | |
|---|---|---|---|
| 0309733 | 12/1988 | Japan | 60/760 |

*Primary Examiner*—Charles G. Freay

[57] ABSTRACT

A method of converting a steam cooled transition to an air cooled transition in a gas turbine having a compressor in fluid communication with a combustor, a turbine section in fluid communication with the combustor, the transition disposed in a combustor shell and having a cooling circuit connecting a steam outlet and a steam inlet and wherein hot gas flows from the combustor through the transition and to the turbine section, includes forming an air outlet in the transition in fluid communication with the cooling circuit and providing for an air inlet in the transition in fluid communication with the cooling circuit.

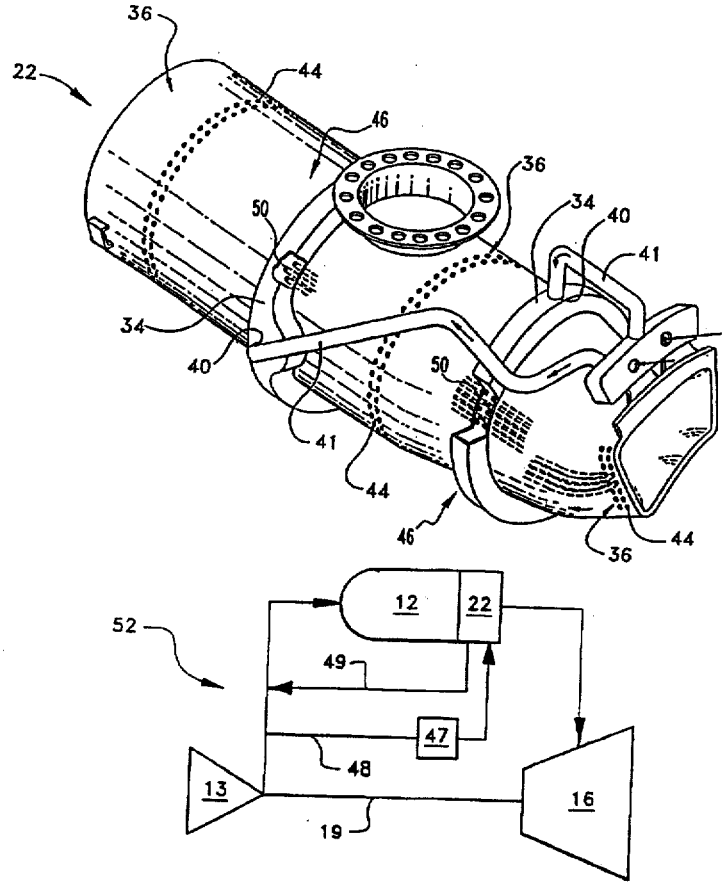

20 Claims, 6 Drawing Sheets